US005526665A

United States Patent [19]

Smith

[11] Patent Number: 5,526,665

[45] Date of Patent: Jun. 18, 1996

[54] APPARATUS FOR STRAIGHTENING COILED WIRE

[75] Inventor: Richard J. Smith, West Haven, Conn.

[73] Assignee: United States Surgical Corporation, Norwalk, Conn.

[21] Appl. No.: 959,059

[22] Filed: Oct. 9, 1992

[51] Int. Cl.[6] ..... B21F 1/04

[52] U.S. Cl. ..... 72/79; 140/147

[58] Field of Search ..... 72/79, 119, 164; 140/140, 147

[56] References Cited

U.S. PATENT DOCUMENTS

| | | | |
|---|---|---|---|
| 1,735,833 | 11/1929 | Matteson | 140/147 |
| 2,938,563 | 5/1960 | Rohlfs | 72/79 |
| 3,443,607 | 5/1969 | Dittrich | 140/147 |
| 3,595,277 | 7/1971 | Lefever | 140/147 |
| 3,625,263 | 12/1971 | Kopczynski | 140/147 |
| 3,857,266 | 12/1974 | Wilke | 140/147 |
| 3,910,321 | 10/1975 | McKeever | 140/147 |
| 4,046,177 | 9/1977 | Louis et al. | 140/147 |
| 4,177,843 | 12/1979 | Sarver | 140/147 |
| 4,194,541 | 3/1980 | Ditges | 140/147 |
| 4,261,396 | 4/1981 | Perrenoud | 140/147 |
| 4,335,758 | 6/1982 | Williams | 140/88 |
| 4,355,526 | 10/1982 | Miles | 72/164 |
| 4,391,307 | 7/1983 | Levi et al. | 140/140 |
| 4,464,916 | 8/1984 | Grew et al. | 72/17 |
| 4,464,919 | 8/1984 | Labbe | 72/162 |
| 4,610,281 | 9/1986 | Fuchs et al. | 140/140 |
| 4,688,412 | 8/1987 | Hoffmann | 72/110 |
| 4,770,016 | 9/1988 | Stepanenko et al. | 72/64 |
| 4,774,824 | 10/1988 | Ritter et al. | 72/5 |
| 4,788,844 | 12/1988 | Summers et al. | 72/110 |
| 4,920,776 | 5/1990 | Denzler | 72/79 |
| 4,977,934 | 12/1990 | Anderson et al. | 140/147 |
| 5,042,280 | 8/1991 | Anagnostopoulos | 72/79 |

FOREIGN PATENT DOCUMENTS

| | | | |
|---|---|---|---|
| 0154311 | 9/1982 | Japan | 72/39 |

*Primary Examiner*—Lowell A. Larson
*Assistant Examiner*—Thomas C. Schoeffler

[57] ABSTRACT

An apparatus for straightening wire stock includes a support member defining a generally elongated opening adapted for advancement of the wire stock therethrough, at least a first pair of engaging members associated with the support member and extending from a first direction sufficiently to engage the wire stock during advancement through the opening, at least a second pair of engaging members associated with the support member and extending from a second direction sufficiently to engage the wire stock during advancement through the opening, a mechanism for rotating the first and second pairs of the engaging members about an axis in general alignment with a longitudinal axis defined by the support member and a mechanism for selectively adjusting the positions of at least one of the first and second pairs of the engaging members relative to the longitudinal axis.

23 Claims, 6 Drawing Sheets

APPARATUS FOR STRAIGHTENING COILED WIRE

BACKGROUND OF THE INVENTION

1. Field of the Invention

The present invention relates to an apparatus and method for straightening wire stock.

2. Description of the Prior Art

Conventional wire straighteners are either of the roller type or the rotary die type. The roller type typically includes a series of guiding rollers arranged in general alignment with each other. The wire is advanced through the rollers and flexed in opposite directions to substantially straighten the wire. The rotary type generally consists of several dies housed in a wire straightening arbor. The dies are arranged in sequence and in an offset manner. The wire is threaded through the dies and the arbor is rotated as the wire is advanced therethrough to perform the straightening function.

A significant disadvantage with conventional wire straightening devices, particularly of the rotary type, is the inability to adjust the positioning of the dies relative to the wire path in an effective and efficient manner. Nor is it possible in conventional rotary straighteners to adjust the positioning of the dies during operation of the apparatus. Repositioning of the dies is often necessary to ensure the quality or accuracy of the straightened wire product. Conventional straighteners often incorporate adjusting mechanisms, e.g., set screws, which require the apparatus to be disabled before any adjustments can be made. Accordingly, this often results in excessive time spent in setting up the dies to achieve an appropriate positioning of the dies relative to the wire path, which consequently results in reduced productivity.

Therefore, it would be desirable to provide an apparatus for wire straightening which can effectively and efficiently produce a straightened wire product with a high level of accuracy. It would also be desirable to provide an adjusting mechanism for use with the apparatus, which mechanism can readily adjust the lateral positioning of the dies relative to the wire path particularly during operation of the apparatus.

SUMMARY OF THE INVENTION

Generally stated, the present invention is directed to an apparatus for straightening wire stock. The apparatus comprises support means defining a generally elongated opening having a generally longitudinal axis. The elongated opening is adapted for advancement of the wire stock therethrough. The apparatus further comprises at least a first pair of engaging means associated with the support means and extending from a first direction sufficiently to engage the wire stock during advancement through the opening, at least a second pair of engaging means associated with the support means and extending from a second direction sufficiently to engage the wire stock during advancement through the opening, means for rotating the first and second pairs of the engaging means about an axis in general alignment with the longitudinal axis and means for selectively adjusting the positions of at least one of the first and second pairs of engaging means relative to the longitudinal axis.

More particularly, the present invention is directed to an apparatus for straightening wire stock which comprises housing means defining a generally central elongated opening and having a generally longitudinal axis, means for advancing the wire stock through the elongated opening of the housing means along a wire path in general alignment with the longitudinal axis of the housing means, first die means associated with the housing means and extending from a first direction sufficiently into the opening to contact the wire stock being advanced along the wire path and second die means associated with the housing means and interdigitating with the first die means. The second die means extends into the opening from a direction opposite the direction of the first die means sufficiently to contact the wire stock being advanced along the wire path. The apparatus further comprises means for selectively adjusting positions of at least one of the first and second die means relative to the longitudinal axis, means for rotating the housing means to vary contact between the first and second die means and the wire stock sufficient to substantially straighten the wire stock and means for simultaneously and selectively adjusting the positions of the first and second die means relative to the longitudinal axis.

In the preferred embodiment, the first and second die means each comprise at least two die elements. Preferably, the die elements of the first and second die means are symmetrically arranged about a central transverse axis defined by a central die element such that contacting surfaces of corresponding opposed pairs of the die elements on each side of the central axis are laterally displaced substantially the same distance from the longitudinal axis and wherein the lateral displacement of each of the corresponding pairs increases towards the central die element.

The preferred adjusting means is adapted to simultaneously adjust the lateral displacement of the die elements of the first and second die means during operation of the apparatus. The adjusting means is also adapted to maintain the symmetrical arrangement of the die elements of the first and second die means about the center-most die element.

The apparatus further comprises means associated with the adjusting means for selectively moving the first and second die means between a first retracted position wherein the die elements do not intersect the longitudinal axis and a second extended position wherein the first and second die means intersect the longitudinal axis to engage the wire stock. The moving means enables the operator to thread the wire stock through the die elements prior to activation of the apparatus.

The present invention is also directed to a method for straightening wire stock, comprising the steps of advancing wire stock along a generally longitudinal path extending through a housing member, positioning first die means such that contacting surfaces thereof extend in a first direction sufficiently into the longitudinal path to contact the wire stock being advanced along the wire path, positioning second die means such that contacting surfaces thereof extend in a second direction sufficiently into the longitudinal path to contact the wire stock being advanced along the wire path and rotating the housing means to cause varying contact between the first and second die means and the wire stock sufficient to substantially straighten the wire stock.

BRIEF DESCRIPTION OF THE DRAWINGS

Preferred embodiments of the invention will be described hereinbelow with reference to the drawings wherein.

DETAILED DESCRIPTION OF THE PREFERRED EMBODIMENTS

Figure 1:
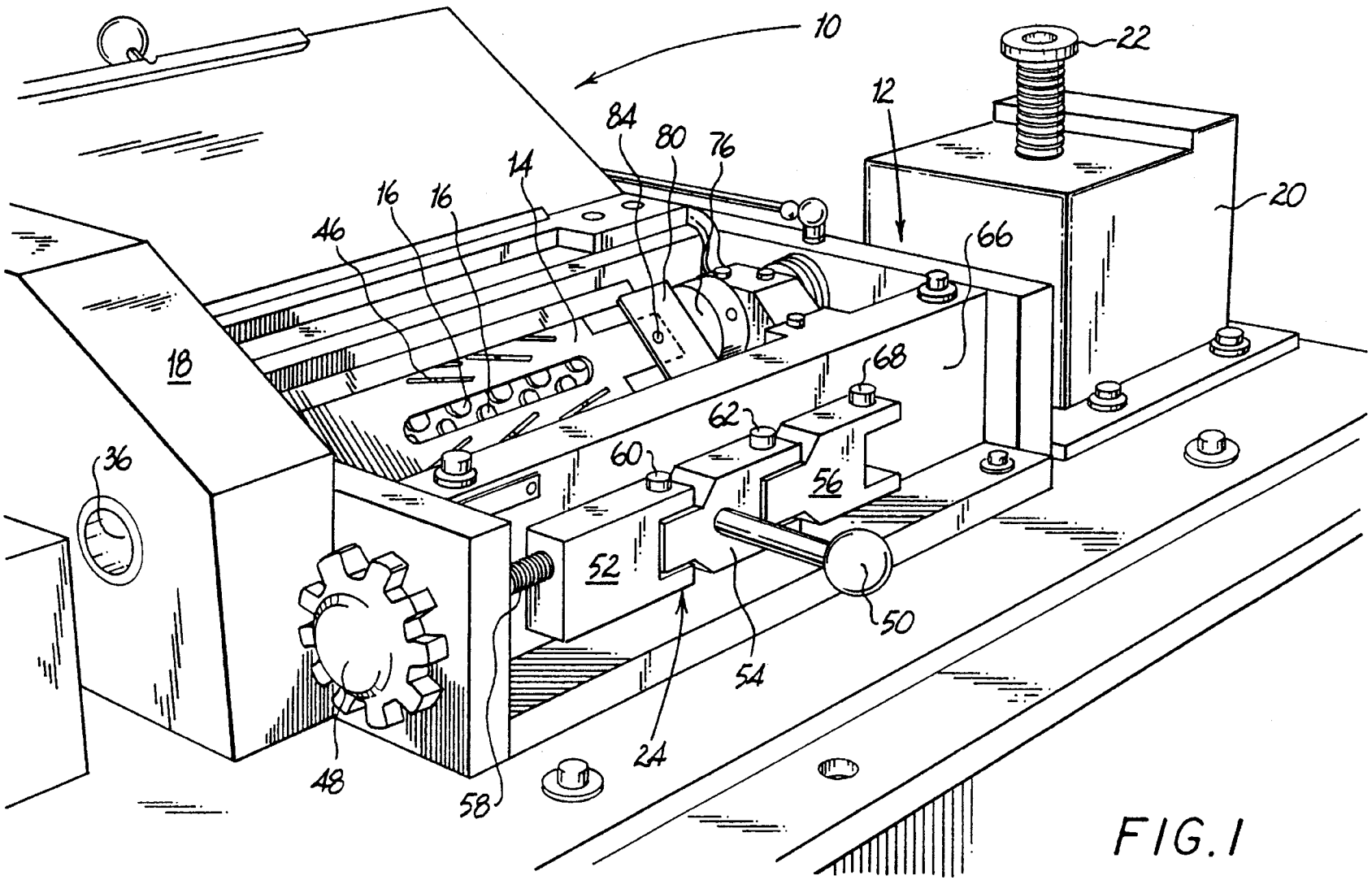
FIG. 1 illustrates a perspective view of the apparatus for straightening wire as constructed according to the present invention.

Referring initially to FIG. 1, there is illustrated a perspective view of a wire straightening apparatus constructed according to the present invention. Apparatus 10 is intended to straighten wire stock which has achieved a "coil set" due to its storage on a wire spool or the like. Apparatus 10 is particularly contemplated for use in surgical needle manufacture although one skilled in the art will find other applications for apparatus 10.

Apparatus 10 includes frame 12 and straightener head 14 rotatably mounted within the frame. Straightener head 14 houses a plurality of die elements 16 which perform the wire straightening function. Die elements 16 are positioned to engage and flex the wire stock from at least two different directions as the wire is passed through straightener head 14 so that the wire is substantially straight when it exits the apparatus.

Apparatus 10 includes a first drive motor (not shown) which is disposed within motor casing 18. The first drive motor is operatively connected to straightener head 14 and imparts continuous rotational motion to the straightener head during operation of the apparatus such that the wire stock is engaged by opposed die elements from an infinite number of directions. The first drive motor may be any conventional motor suitable for this purpose.

A second drive motor is disposed adjacent the rear side of apparatus 10 within motor casing 20. The second drive motor engages the wire stock passed through straightener head 14 and continually advances the wire stock through the apparatus. The second drive motor preferably includes a set of gears (not shown) to grip the wire stock. The relative positioning of the gears are preferably adjustable by gear adjusting screw 22 to accommodate wire stock of various diameters.

Referring still to FIG. 1, apparatus 10 further includes a linkage mechanism, identified generally by the reference numeral 24, which is operatively connected to straightener head 14. Linkage mechanism 24 serves two functions: 1) it enables the operator to adjust the positions of die elements 16 relative to the wire stock during operation of the apparatus; and 2) it permits the operator to initially separate die elements 16 prior to activation of the apparatus to thread the wire stock through straightener head 14 and between the die elements. The components and operation of linkage mechanism 24 will be discussed below.

Figure 2:
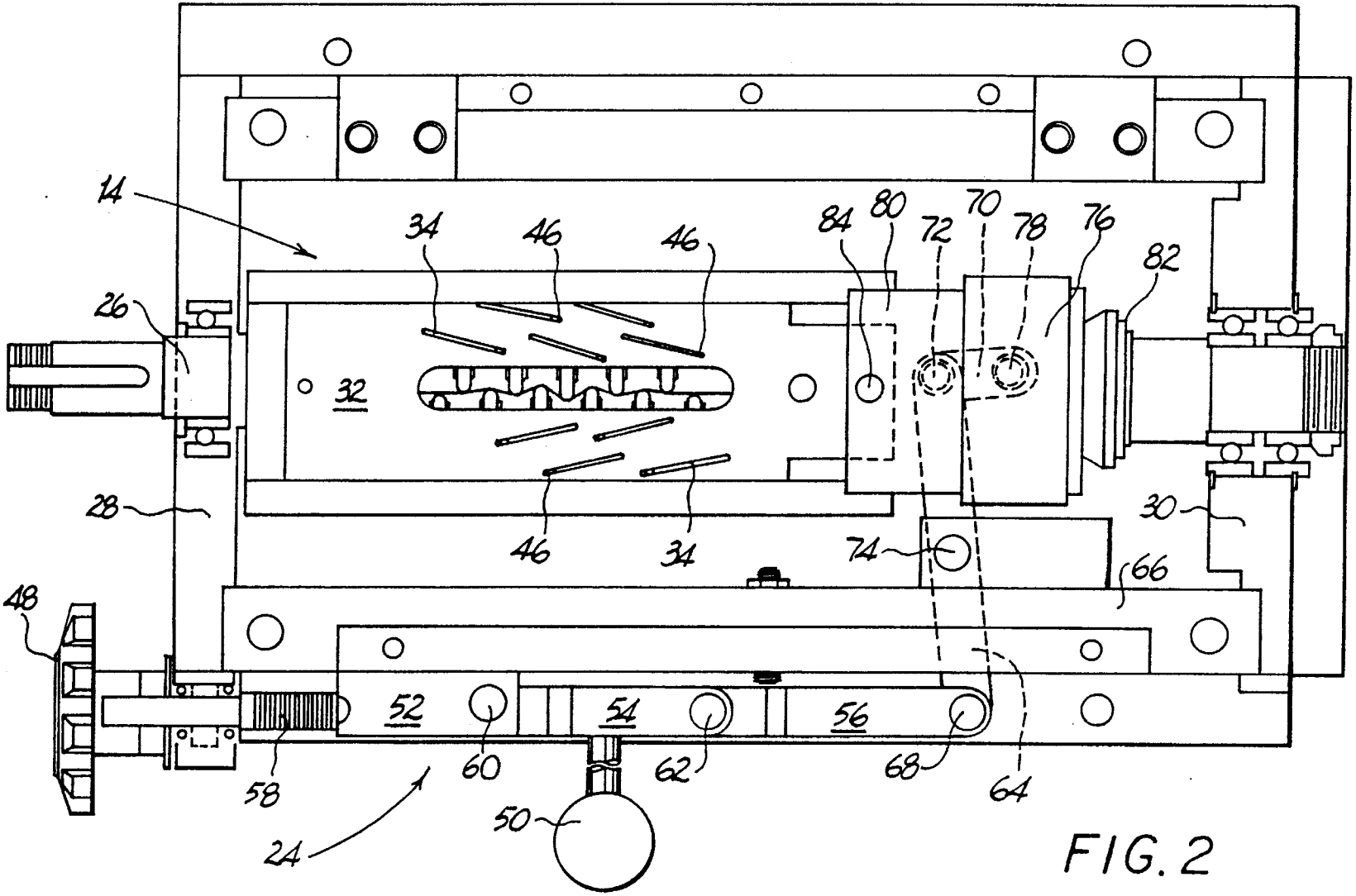
FIG. 2 is a top plan view of the apparatus of FIG. 1 illustrating the adjusting plate in a retracted position with the die elements in an engaged relation with the wire path.

Referring now to FIG. 2, there is illustrated a top plan view of apparatus 10. Straightener head 14 is securely mounted to drive shaft 26, which shaft is rotatably mounted to forward and rear plates 28,30 of frame 12, respectively, by conventional means. The forward portion of drive shaft 26 extends beyond forward plate 28 and is operatively connected to the first drive motor, preferably, by a belt system (not shown) or the like to impart rotational movement to straightener head 14.

An adjusting plate 32 is slidably mounted to an upper surface of straightener head 14. Adjusting plate 32 reciprocally moves relative to straightener head 14 in response to corresponding movement of linkage mechanism 24. Movement of adjusting plate 32 adjusts the lateral positioning of dies 16 relative to the wire path as will become appreciated from the description below. Adjusting plate also includes a plurality of angularly oriented elongated apertures 34 formed therein.

Figure 3:
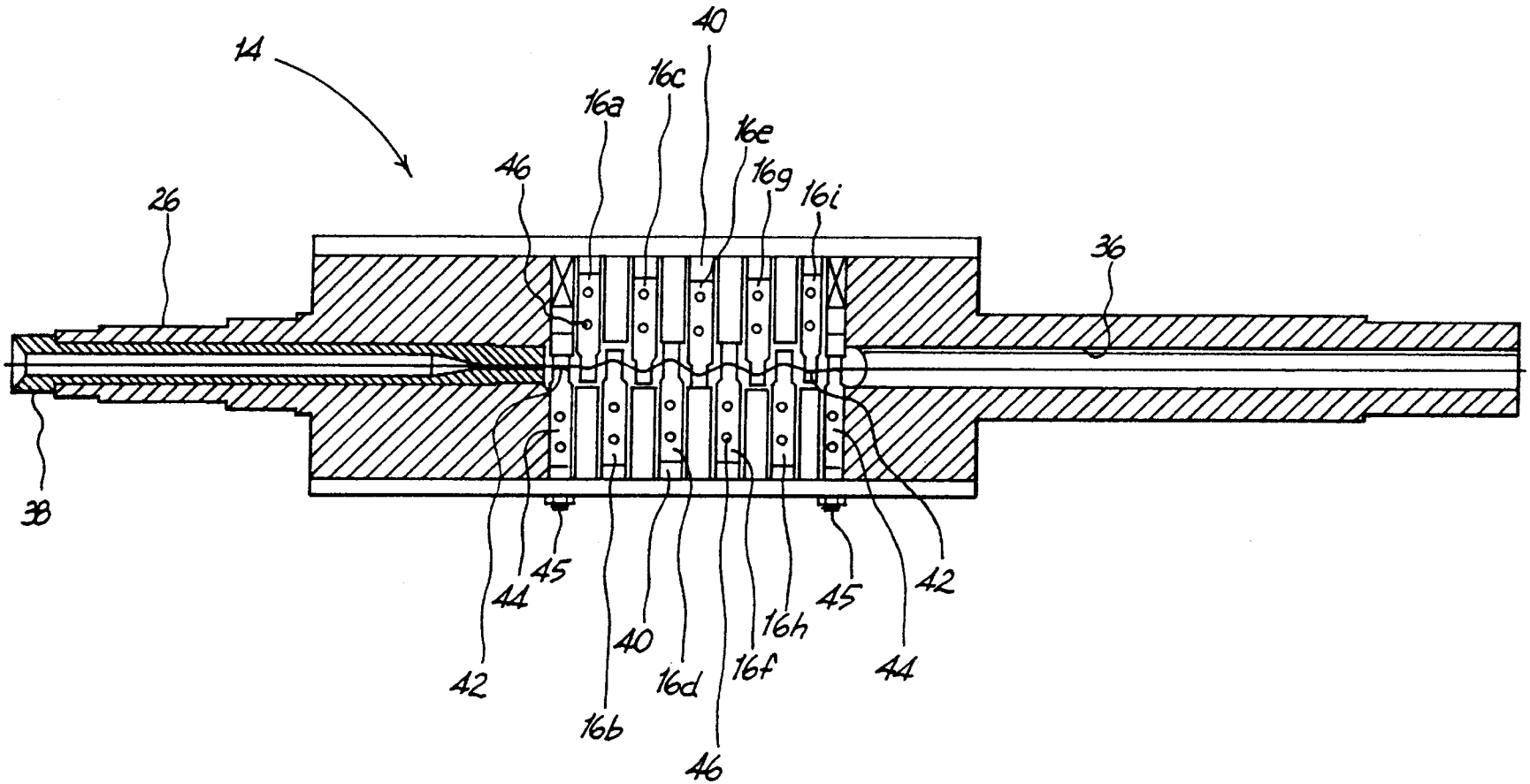
FIG. 3 is a cross-sectional view of the straightener head and drive shaft illustrating the positioning of the die elements when the adjusting plate is in the retracted position of FIG. 2 and the sinusoidal configuration the wire assumes as it is passed through the die elements.

Referring now to FIG. 3. a cross-section of straightener head 14 and drive shaft 26 is illustrated. Drive shaft 26 includes a longitudinal bore 36 extending therethrough which defines a generally longitudinal axial path for the wire stock through the apparatus. The axial path defined by bore 36 is in general alignment with a longitudinal axis defined by straightener head 14 such that the wire path defined by the bore passes through die elements **16*a*–16*i* of the straightener head. Drive shaft 26 is provided with a wire guide member 38 which is inserted within bore 36 at the forward end of the shaft. Guide member 38 facilitates introduction of the wire stock into drive shaft 26 and assists in aligning the wire stock with die elements 16*a*–16*i***.

Die elements **16*a*–16*i* are disposed on opposed sides of the longitudinal axis defined by straightener head 14 in an interdigitating manner as shown. Each die element 16*a*–16*i* is mounted within a respective mounting channel 40 and is positioned to intersect the longitudinal axis defined by straightener head 14 and engage the wire stock as it advances through the apparatus to alter the path of the wire as shown. Each die element 16 defines an arcuate contacting surface 42 which permits the wire advanced through the die elements to bend thereabout to cause the wire stock to assume a generally sinusoidal shape. The individual die elements 16*a*–16*i* are respectively positioned in a generally symmetrical arrangement about the center die element 16*e*. In particular, corresponding dies on each side of a central axis defined by center die 16*e* are disposed at the same location relative to the wire path, i.e., the contacting surfaces 42 of the corresponding die elements are laterally displaced substantially the same distance from the longitudinal axis defined by straightener head 14. For example, corresponding dies 16*a* and 16*i* are respectively positioned such that their respective contacting surfaces 42 are laterally displaced from the longitudinal axis at substantially equal distances. Similarly, the lateral displacement of contacting surfaces of corresponding dies 16*b*, 16*h* is substantially equivalent. Further, die elements 16*a*–16*i* are respectively positioned such that the lateral displacement of respective contacting surfaces 42 of corresponding die elements gradually increases towards the central most die element 16*e* as shown. Accordingly, with this particular arrangement of dies 16*a*–16*i*, the wire stock assumes a generally harmonic sinusoidal configuration which is symmetric about the central most die element 16*e* and which incrementally decreases in amplitude away from the central most die element. (see also FIG. 2**)

Figure 6:
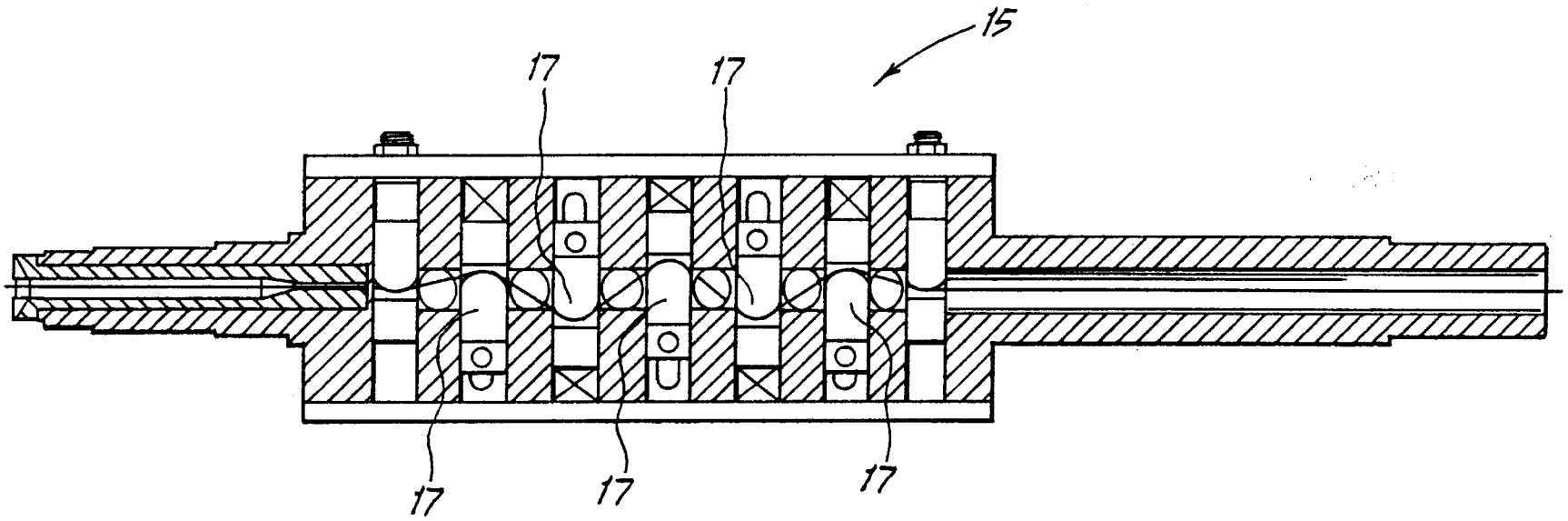
FIG. 6 is a cross-sectional view of an alternative straightener head and die element arrangement which can be used with the apparatus of the present invention.

In the preferred embodiment, straightener head 14 includes five die elements 16 on a first side of the longitudinal axis and four die elements 16 on a second side of the path. In an alternative embodiment, shown in FIG. 6, straightener head 15 includes two die elements 17 on a first side of the longitudinal axis and three die elements 17 on a second side of the path.

Referring again to FIG. 3, straightener head 14 also includes guide die elements 44 disposed at the front and rear of the die elements **16*a*–16*i*, respectively. Guide die elements 44 are positioned such that contacting surfaces thereof are generally tangent to the wire path. This positioning facilitates entry and exit of the wire stock through straightener head 14. The positioning of guide dies 44 are independently adjusted by screw means 45** or the like.

Referring again to FIG. 2, taken in conjunction with FIG. 3, each die element **16*a*–16*i* includes at least one mounting post 46 on an upper surface thereof. Each mounting post 46 is received within a corresponding elongated aperture 34 formed in adjusting plate 32. Accordingly, sliding movement of adjusting plate 32 relative to straightener head 14 causes mounting posts 46 to slide within their respective apertures 34, which sliding movement adjusts the respective positionings of the die elements 16 within their mounting channels 40 and relative to the longitudinal wire path. It is to be appreciated that elongated apertures 34 of adjusting plate 32 are strategically positioned and angularly oriented in a manner such that corresponding die elements 16*a*–16*i* on each side of the central most die element 16*e*** are displaced the same distance relative to the wire path after an adjusting movement of the plate.

Referring again to FIGS. 1–2, the linkage mechanism 24 for effecting sliding movement of adjusting plate 32 and for separating die elements 16 will now be described. Linkage mechanism 24 includes adjusting knob 48, handle 50 and a plurality of interconnected link members 52, 54 and 56. Adjusting knob 48 has a threaded member 58 mounted thereto which is threadably connected to first link member 52. First link 52 is operatively connected to second link member 54 via pin 60, which second link 54 is operatively connected to third link member 56 via pin 62. As best illustrated in FIG. 2, pivoting link 64 (shown in phantom) extends through plate 66 of frame 12 and is connected at one end portion thereof to third link 56 via pin 68 and at a second end portion thereof to collar link 70 via pin 72. Pivot link 64 pivots about stationary pin 74 in response to longitudinal movement of third link member 56. Collar link 70 is mounted to adjustable collar member 76 via pin 78. Collar member 76 is adapted for reciprocal longitudinal movement in response to corresponding pivotal movement of pivot link 64. An annular sleeve 80 is received within and extends through an annular channel (not shown) formed in collar member 76 wherein it is secured to the rear side of the collar member by locking nut 82. Sleeve 80 is adapted to freely rotate within collar member 76 during rotational movement of straightener head 14. Sleeve 80 is operatively connected to adjusting plate 32 via screw 84.

The operator rotates adjusting knob 48 to adjust the positioning of dies 16 relative to the longitudinal axial path. For example, to reduce the lateral displacement of dies 16 relative to the longitudinal axis defined by straightener head 14, adjusting knob 48 is rotated in a clockwise direction to cause longitudinal movement of link members 52, 54 and 56 towards front plate 28 of frame 12, which movement effects clockwise pivotal movement of pivoting link 64 about stationary pin 74.

Figure 4:
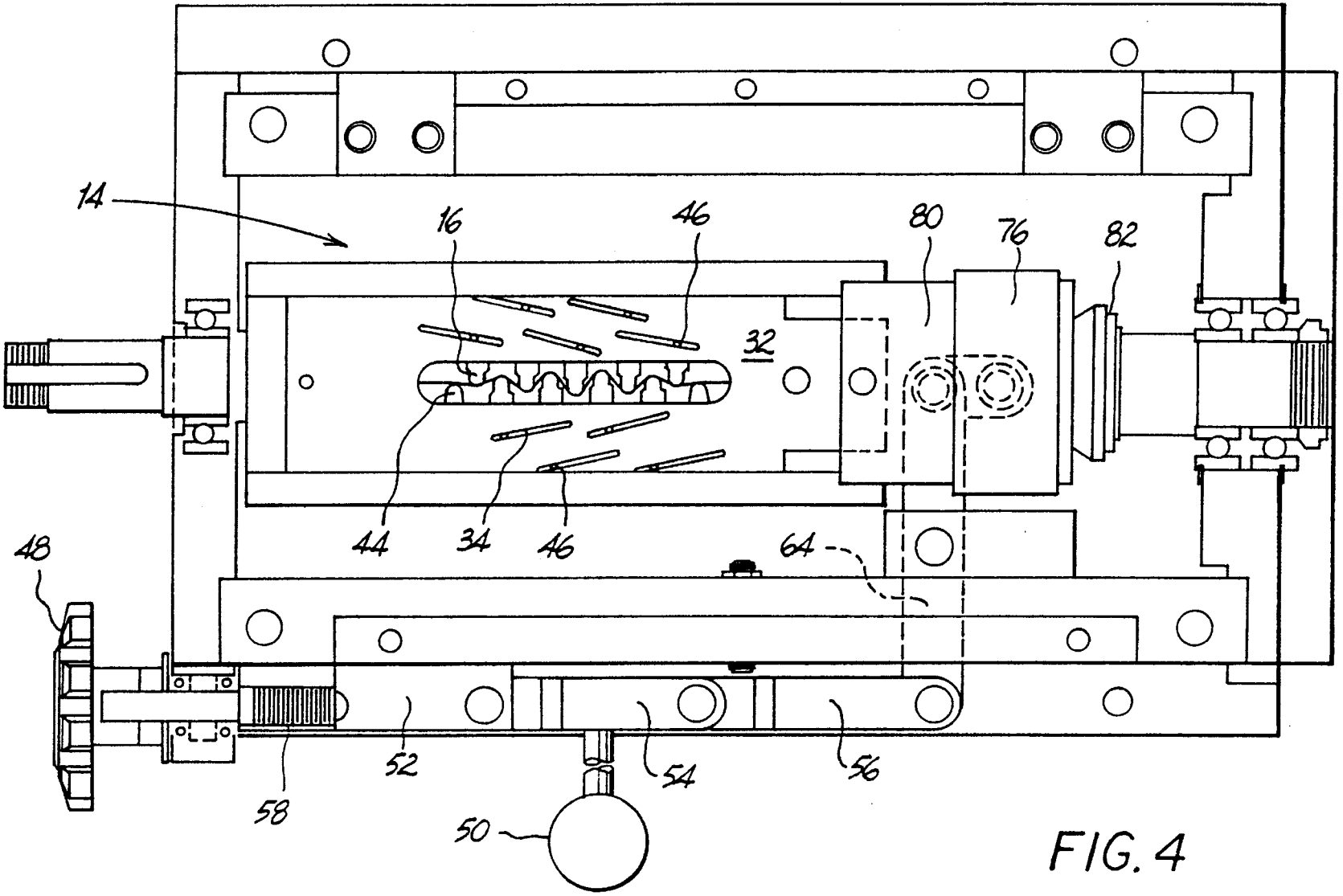
FIG. 4 is a top plan view similar to FIG. 2 illustrating the adjusting plate of the straightener head in a slightly advanced position to adjust the positioning of the die elements relative to the wire path.

As best shown in FIG. 4, clockwise pivotal movement of pivoting link 64 drives collar member 76 towards the rear end of the apparatus, which, accordingly, advances sleeve 80 in the same direction. Consequently, adjusting plate 32 advances towards the rear end of the apparatus. During advancing movement of adjusting plate 32, mounting posts 46 of each die element 16 slide within their respective elongated openings 34 formed in adjusting plate 32 to reposition the die elements within mounting channels 40 in a direction away from the wire path. Such longitudinal movement of adjusting plate 32 reduces the lateral displacement of corresponding die elements 16 relative to the longitudinal axis defined by housing member 14 and consequently reduces the respective amplitudes of the sinusoidal configuration of the wire stock. It is to be noted that elongated apertures 34 of adjusting plate 32 are angularly oriented in a manner such that the symmetrical arrangement of die elements 16 is retained after longitudinal movement of the adjusting plate.

Figure 5:
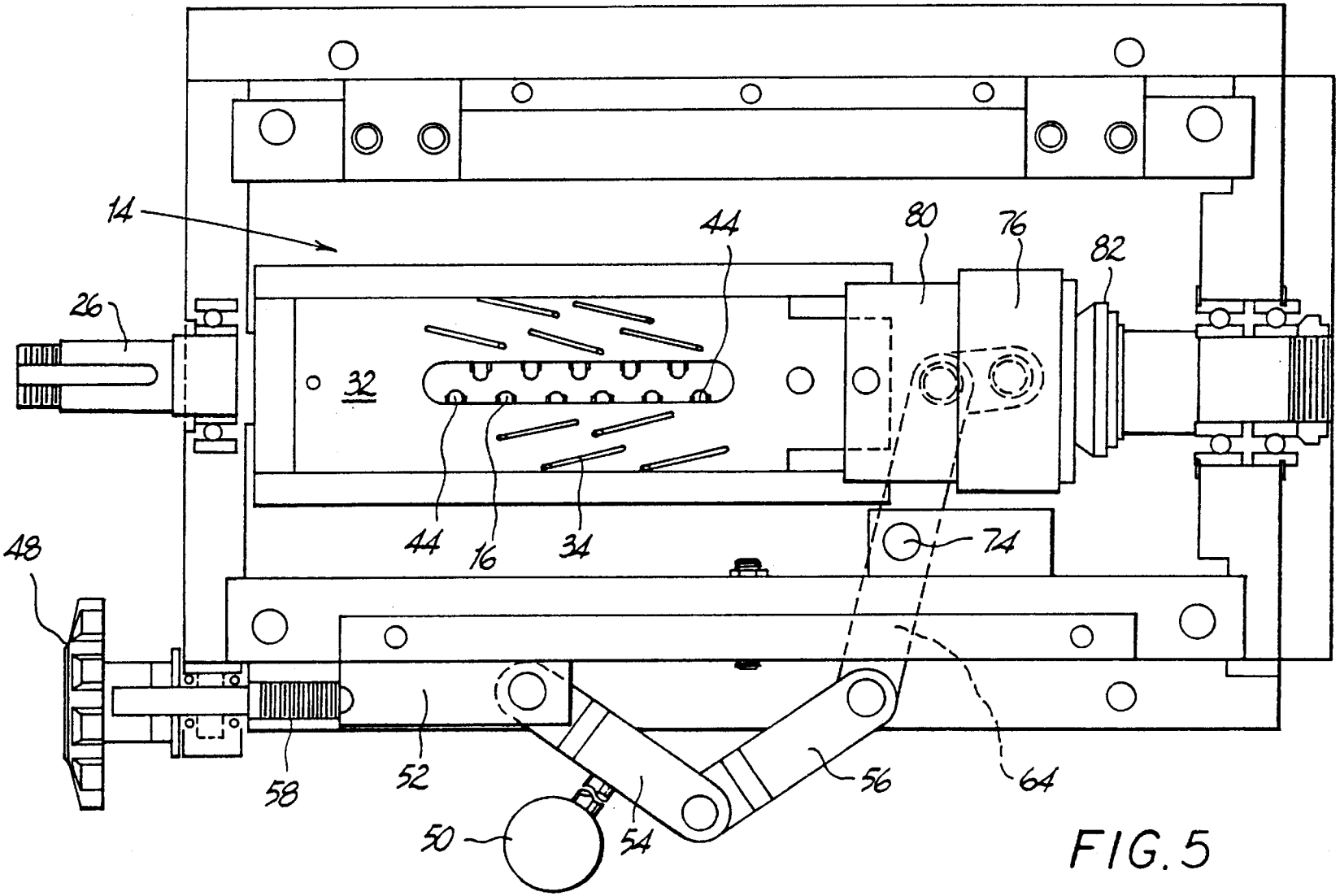
FIG. 5 is a top plan view similar to FIG. 4 illustrating the linkage mechanism in an open position to separate the die elements to thread the wire stock through the straightener head.

Linkage mechanism 24 is also provided with handle 50 to open and close the dies prior to actuation of the apparatus to facilitate feeding of the wire stock through straightener head 14. Handle 50 is connected to second link 54 and is pulled outwardly away from frame 12 as shown in FIG. 5 to draw second and third links 54,56 outwardly and towards the forward end of apparatus 10. Such movement effects maximum pivoting action of pivoting link 64, which, in turn, effects sufficient longitudinal movement of collar 76 and adjusting plate 32 to completely open die elements 16.

In the open position of linkage mechanism 24, the wire stock is fed through opening 86 disposed in motor casing 18 (see FIG. 1), which opening is in alignment with guide member 38 inserted within drive shaft 26. Prior to feeding the wire into apparatus 10, the wire stock may be passed through an ultrasonic cleanser, identified schematically as reference numeral 88, to substantially clean the wire. The wire stock is continually advanced through guide member 38 between die elements **16*a*–16*i* and out the rear end of shaft 26. Thereafter, the wire is inserted within the second drive motor disposed within casing 20** where it is engaged by the gears (not shown).

The present invention provides an apparatus for wire straightening which can effectively and efficiently straighten wire stock for subsequent manufacturing purposes. The adjusting mechanism incorporated in the present invention enables the operator to continually adjust the positioning of the dies relative to the wire path during operation of the apparatus so as to ensure that the wire is straight when it exits the apparatus.

While the above description contains many specifics, these specifics should not be construed as limitations on the scope of the invention, but merely as an exemplification of a preferred embodiment thereof. Those skilled in the art will envision other possible variations that are within the scope and spirit of the invention as defined by the claims appended hereto.

What is claimed is:

1. Apparatus for straightening wire stock which comprises:

support means defining a generally elongated opening having a generally longitudinal axis and adapted for advancement of the wire stock therethrough;

at least a first pair of engaging means associated with said support means and extending from a first direction sufficiently to engage the wire stock during advancement through said opening;

at least a second pair of engaging means associated with said support means and extending from a second direction sufficiently to engage the wire stock during advancement through said opening;

means for rotating said first and second pairs of said engaging means about an axis in general alignment with said longitudinal axis; and means for selectively and simultaneously adjusting positions of said first and second pairs of said engaging means relative to said longitudinal axis during operation of the apparatus, said adjusting means actuated by a single control knob.

2. Apparatus for straightening wire stock which comprises:

housing means having a generally central elongated opening and defining a generally longitudinal axis, said opening adapted for reception of wire stock therethrough;

means for advancing the wire stock through said elongated opening of said housing means along a wire path in general alignment with said longitudinal axis of said housing means;

first die means associated with said housing means and extending from a first direction sufficiently into said opening to contact the wire stock being advanced along said wire path;

second die means associated with said housing means and interdigitating with said first die means, said second die means extending into said opening from a second direction opposite the first direction of said first die means sufficiently to contact the wire stock being advanced along said wire path;

means for rotating said housing means to vary contact between said first and second die means and the wire stock sufficiently to substantially straighten the wire stock;

single control means for simultaneously and selectively adjusting positions of said first and second die means relative to said longitudinal axis, said single control means actuated by a single control knob; and release means associated with said single control means for moving said first and second die means between a first retracted position wherein said first and second die means do not intersect said longitudinal axis and a second interdigitated position wherein the wire stock is engaged by said first and second die means, said release means actuated by a manually operable handle member wherein movement of said handle member to a first position thereof causes movement of said first and second die means to said first retracted position and wherein movement of said handle member to a second position thereof causes movement of said first and second die means to said second interdigitated position.

3. The apparatus according to claim 2 wherein said first and second die means each comprise at least two die elements.

4. The apparatus according to claim 3 wherein each said die element defines an arcuate wire contacting surface which permits the wire stock to bend thereabout.

5. The apparatus according to claim 4 wherein said die elements of said first die means includes a central-most die element, said central-most die element defining a central axis generally transverse to said longitudinal axis.

6. The apparatus according to claim 5 wherein said die elements of said first die means are symmetrically arranged about said central axis, whereby said contacting surfaces of corresponding opposed pairs of said die elements on each side of said central axis are laterally displaced substantially the same distance from said longitudinal axis and wherein the lateral displacement of said contacting surfaces of each of said corresponding opposed pairs of said die elements of said first die means increases towards said central axis.

7. The apparatus according to claim 6 wherein said die elements of said second die means are symmetrically arranged about said central axis, whereby said contacting surfaces of corresponding opposed pairs of said die elements on each side of said central axis are laterally displaced substantially the same distance from said longitudinal axis and wherein the lateral displacement of said contacting surfaces of each of said corresponding opposed pairs of said die elements of said second die means increases towards said central axis.

8. The apparatus according to claim 7 wherein said adjusting means is adapted to simultaneously adjust the lateral displacement of said contacting surfaces of said die elements of said first and second die means during operation of the apparatus, said adjusting means being further adapted to maintain the symmetrical arrangement of said die elements of said first and second die means about said central axis.

9. The apparatus according to claim 8 wherein said first die means comprises five said die elements and wherein said second die means comprises four said die elements.

10. The apparatus according to claim 9 further comprising an entry die element disposed adjacent a forward-most die element of said second die means and an exit die element disposed adjacent the rear-most die element of said second die means.

11. The apparatus according to claim 9 wherein said first die means comprises two said die elements and wherein said second die means comprises three said die elements.

12. The apparatus according to claim 11 further comprising an entry die element disposed adjacent the forward-most die element of said first die means and an exit die element disposed adjacent a rear-most die element of said first die means.

13. The apparatus according to claim 2 further comprising means for cleansing the wire stock prior to introduction thereof into said first and second die means.

14. The apparatus according to claim 13 wherein said cleansing means comprises an ultrasonic cleanser.

15. Apparatus for straightening wire stock, which comprises:

housing means having a generally central elongated opening and defining a generally longitudinal axis, said elongated opening adapted for reception of the wire stock therethrough;

means for advancing the wire stock through said elongated opening of said housing means along a wire path in general alignment with said longitudinal axis of said housing means;

a plurality of die elements mounted to said housing means in an interdigitating opposed manner and extending sufficiently into said opening such that contacting surfaces thereof engage the wire stock being advanced along said wire path, said die elements symmetrically arranged about a central transverse axis defined by a central die element such that said contacting surfaces of corresponding opposed pairs of said die elements on each side of said central axis are laterally displaced substantially the same distance from said longitudinal axis and wherein the lateral displacement of each of said corresponding pairs increases towards the central die element; and means for simultaneously and selectively adjusting the lateral displacement of said die elements during actuation of the apparatus, said adjusting means retaining the symmetrical arrangement of said die elements and being actuated by a single control knob.

16. The apparatus according to claim 15 wherein said adjusting means comprises:

an adjusting plate slidably mounted to an upper surface of said housing means; and means for engaging said adjusting plate with said die elements.

17. The apparatus according to claim 16 wherein said engaging means comprises a plurality of elongated openings formed in said adjusting plate, each said elongated opening configured and dimensioned to receive a mounting post extending from an upper surface of a correspondingly positioned die element.

18. The apparatus according to claim 17 wherein said elongated openings are angularly oriented relative to said wire path.

19. The apparatus according to claim 18 wherein said rotating means comprises motor means.

20. The apparatus according to claim 15 further comprising means associated with said adjusting means for selectively moving said first and second die means between a first retracted position wherein said die elements do not intersect said longitudinal axis and a second extended position wherein said first and second die means intersect said longitudinal axis to engage the wire stock.

21. Apparatus for straightening wire stock comprising:

a frame;

an elongated housing mounted in said frame for rotational motion about a longitudinal axis thereof, said housing having a generally central elongated opening in general alignment with said longitudinal axis, said opening adapted for reception of wire stock therethrough;

a plurality of dies mounted in said housing in an interdigitating opposed manner and extending sufficiently into said opening such that contacting surfaces thereof engage the wire stock being advanced along said wire path;

means for advancing the wire stock through said elongated opening of said housing along a wire path in general alignment with said longitudinal axis of said housing and;

release means for moving said dies between a first retracted position wherein said dies do not intersect said longitudinal axis and a second interdigitated position wherein the wire stock is engaged by said dies, said release means actuated by a manually operable handle member wherein movement of said handle member to a first position thereof causes movement of said dies to said first retracted position and wherein movement of said handle member to a second position thereof causes movement of said dies to said second interdigitated position.

22. A method for straightening wire stock, comprising the steps of:

advancing wire stock along a generally longitudinal path extending through a housing member;

positioning first die means such that contacting surfaces thereof extend in a first direction sufficiently into said longitudinal path to contact the wire stock being advanced therealong;

positioning second die means such that contacting surfaces thereof extend in a second direction sufficiently into said longitudinal path to contact the wire stock being advanced therealong;

rotating said housing means to cause varying contact between said first and second die means and the wire stock; and simultaneously and selectively adjusting the positions of said first and said second die means relative to said longitudinal path to substantially straighten the wire stock.

23. A method for straightening wire stock, comprising the steps of:

advancing wire stock along a generally longitudinal path extending through a housing member;

positioning a plurality of die elements in an opposed interdigitating manner such that contacting surfaces thereof extend sufficiently into said longitudinal path to engage the wire stock being advanced therealong whereby said die elements are symmetrically arranged about a central axis defined by a central die element such that said contacting surfaces of corresponding opposed pairs of die elements on each side of said central axis are laterally displaced at substantially the same distance from said longitudinal path and wherein the lateral displacement of each of said corresponding pairs increases towards the central die element;

rotating said housing means; and simultaneously and selectively adjusting the lateral displacement of said corresponding pairs of said die elements while maintaining the symmetrical arrangement of said die elements about said central axis to substantially straighten the wire stock.

* * * * *